US011274422B2

(12) United States Patent
Wood et al.

(10) Patent No.: US 11,274,422 B2
(45) Date of Patent: Mar. 15, 2022

(54) WEAR MEMBER, EDGE AND PROCESS OF INSTALLATION

(71) Applicant: ESCO Group LLC, Portland, OR (US)

(72) Inventors: Clinton A. Wood, Beaverton, OR (US); Cameron R. Leedham, Portland, OR (US)

(73) Assignee: ESCO GROUP LLC, Portland, OR (US)

( * ) Notice: Subject to any disclaimer, the term of this patent is extended or adjusted under 35 U.S.C. 154(b) by 288 days.

(21) Appl. No.: 16/370,845

(22) Filed: Mar. 29, 2019

(65) Prior Publication Data

US 2019/0376263 A1 Dec. 12, 2019

Related U.S. Application Data

(60) Provisional application No. 62/650,921, filed on Mar. 30, 2018, provisional application No. 62/654,030, filed on Apr. 6, 2018.

(51) Int. Cl.

| | |
|---|---|
| ***E02F 9/28*** | (2006.01) |
| ***E02F 3/40*** | (2006.01) |
| ***E02F 3/60*** | (2006.01) |
| ***E02F 3/815*** | (2006.01) |

(52) U.S. Cl.

CPC ..... *E02F 9/2883* (2013.01); *E02F 3/40* (2013.01); *E02F 3/60* (2013.01); *E02F 3/8152* (2013.01); *E02F 9/2816* (2013.01); *E02F 9/2858* (2013.01)

(58) Field of Classification Search

CPC ..... E02F 3/8152; E02F 9/2808; E02F 9/2816; E02F 9/2858; E02F 9/2883

See application file for complete search history.

(56) References Cited

U.S. PATENT DOCUMENTS

| | | | | |
|---|---|---|---|---|
| 4,329,798 | A | 5/1982 | Edwards | |
| 4,748,754 | A * | 6/1988 | Schwappach | E02F 9/2816 172/713 |
| 4,980,980 | A | 1/1991 | Schadov et al. | |
| 5,088,214 | A * | 2/1992 | Jones | E02F 9/2883 37/450 |
| 7,219,454 | B2 * | 5/2007 | Maher | E02F 9/2833 172/753 |
| 7,451,558 | B2 | 11/2008 | Jones | |
| 7,472,503 | B2 * | 1/2009 | Maher | E02F 9/2841 37/455 |
| 7,536,811 | B2 * | 5/2009 | McClanahan | E02F 9/2833 37/455 |
| 8,024,874 | B2 * | 9/2011 | McClanahan | E02F 9/2883 37/452 |

(Continued)

FOREIGN PATENT DOCUMENTS

| | | |
|---|---|---|
| WO | 2000/028160 | 5/2000 |
| WO | 2014/037780 | 3/2014 |

*Primary Examiner* — Gary S Hartmann

(74) *Attorney, Agent, or Firm* — Steven Schad; Palmer Dzurella

(57) ABSTRACT

Shrouds are secured to earth-working edges of many kinds of earth working equipment to extend the service life of the equipment. The shrouds include opposed surfaces to define a cavity to receive the edge. Each of the opposed surfaces includes a recess to receive a boss on the edge, wherein the longitudinal axis of the recess on the first surface is angularly oriented in a lateral direction to the longitudinal axis of the recess on the second surface.

15 Claims, 9 Drawing Sheets

(56) References Cited

U.S. PATENT DOCUMENTS

| | | | | |
|---|---|---|---|---|
| 8,959,807 | B2 * | 2/2015 | LaHood | E02F 3/8152 37/455 |
| 9,909,285 | B2 * | 3/2018 | Bjerke | E02F 9/2883 |
| 9,938,695 | B2 * | 4/2018 | Bjerke | E02F 9/2825 |
| 10,246,856 | B2 * | 4/2019 | Rol Corredor | E02F 9/2841 |
| 10,487,479 | B2 * | 11/2019 | Marchand | E02F 9/2883 |
| 10,494,794 | B2 * | 12/2019 | Kunz | E02F 9/2833 |
| 10,612,214 | B2 * | 4/2020 | Zenier | E02F 9/2833 |

* cited by examiner

WEAR MEMBER, EDGE AND PROCESS OF INSTALLATION

FIELD OF THE INVENTION

The field of the present disclosure relates to wear members for earth working equipment.

BACKGROUND OF THE INVENTION

During mining and construction operations, replaceable wear members are typically used to protect earth working equipment such as excavation buckets. During use, the wear members gradually wear down due to the abrasive conditions and heavy loading. Once depleted, the wear members are removed from the equipment and replaced. Using wear members provides a cost-effective approach to digging and other earth working operations because it lessens the need of having to repair or replace the more expensive underlying equipment such as the lip or other portions of the equipment.

Wear members are commonly secured to earth working equipment by mechanical means (for example, a lock pin, bolt, or other locking mechanism). During earth working operations, wear members may be subjected to a variety of directional forces, which can include axial, vertical, and lateral loads. Retention of the wear members over their service life prevents damage to downstream equipment such as crushers, limits maintenance downtime of the earthmoving equipment and prevents damage to underlying wear surfaces.

SUMMARY OF THE INVENTION

The present invention pertains to wear members for earth working equipment that are mechanically secured to the equipment. The wear assemblies of the invention are reliable, safe, easy to use, versatile, given to high productivity and/or readily replaceable with little machine downtime.

In one embodiment, a wear member for earth working equipment receives an edge with a boss. The recess and boss each includes planar bearing surfaces that converge forwardly and bear on each other to transfer loads applied to the wear member to the edge.

In another embodiment, a wear assembly includes a wear member secured to an edge of earth working equipment by a lock in an opening of the wear member that bears on a transverse bearing surface of a boss attached to the edge. The boss has bearing surfaces that converge forwardly and away from the transverse surface. The converging bearing surfaces of the boss are received in a recess of the wear member with corresponding forwardly converging surfaces. In one example, the bearing surfaces are planar.

In another embodiment, a wear member with spaced legs forms a cavity to receive an edge of earth working equipment. The wear member includes a first recess in a first leg and a second recess in a second leg to receive the separate bosses attached to the edge. One recess has forwardly converging walls. In one example, the forwardly converging walls of the recess are planar. In another example, the boss includes a transverse rear bearing surface upon which a lock received in an opening of the wear member may bear. The features of these examples may be optionally included and used together or separately.

In another embodiment, a wear member with spaced legs forms a cavity to receive an edge of earth working equipment. The cavity includes a front surface between the legs to bear against the edge. An opening extends through one leg to receive a lock for securing the wear member to the edge. The opening is elongate with a major axis that extends generally parallel to the front surface of the cavity, both of which are at an angle to the direction of edge advancement during use.

In another embodiment, a wear member with spaced legs forms a cavity to receive an edge of earth working equipment. The wear member includes a first recess in a first leg and a second recess in a second leg, each of which receives a separate boss attached to the edge. The longitudinal axis of the first recess extends at an angle to the longitudinal axis of the second recess. In one example, the longitudinal axis of the first recess extends at an angle of less than 25 degrees to the longitudinal axis of the second recess, but other orientations are possible.

In another embodiment, a wear member with spaced legs forms a cavity to receive an edge of earth working equipment. The legs each includes a recess for receiving a boss fixed to the edge wherein the longitudinal axis of the recess in one leg is perpendicular to the front surface of the edge, and the longitudinal axis of the recess in the other leg is parallel to the direction of advancement of the edge during operation of the earth working equipment, wherein the axes are angularly oriented in a lateral direction with respect to each other.

In another embodiment, a stepped edge of earth working equipment mounts a wear member, which is received over first and second bosses secured to opposite sides of the edge. One boss has a longitudinal axis that is perpendicular to the front surface of the edge, and the other boss has a longitudinal axis that is parallel to the direction of edge advancement during operation of the earth working equipment, wherein the axes are angularly oriented in a lateral direction with respect to each other.

In another embodiment, a wear member with spaced legs forms a cavity to receive an edge of earth working equipment. The legs each includes a recess for receiving a boss fixed to the edge wherein the longitudinal axis of one recess is oriented other than parallel to the longitudinal axis of the other recess. In one example, one recess includes bearing surfaces that converge toward a front surface of the cavity. In another example, one recess includes generally parallel bearing surfaces. The features of these examples may be optionally included and used together or separately.

In another embodiment, an edge of earth working equipment includes first and second bosses secured to opposite sides of the edge. One boss has a longitudinal axis that is oriented other than parallel to the longitudinal axis of another boss. In one example, one boss includes bearing surfaces that converge toward a front surface of the edge. In another example, one boss includes generally parallel bearing surfaces. The features of these examples may be optionally included and used together or separately.

In another embodiment, a wear member with spaced legs forming a cavity is installed on an edge of earth working equipment that includes a boss on each of two opposite sides of the edge. The wear member includes a first recess that axially receives one boss, and a second recess that receives the other boss at an angle in a lateral direction to the longitudinal axis of the first recess as the wear member is installed on the edge.

In another embodiment, a wear member with spaced legs forming a cavity is installed on an edge of earth working equipment. The wear member includes a recess that receives a corresponding boss fixed to the edge. The recess and boss include corresponding bearing surfaces that bear against one another during use. During installation of the wear member, one bearing surface moves parallel to its corresponding bearing, whereas the other bearing surface approaches its corresponding bearing surface.

In another embodiment, a wear member with spaced legs forming a cavity is installed on an edge of earth working equipment. The wear member includes a recess in each leg that receives a corresponding boss fixed to the edge. The recesses and bosses include corresponding bearing surfaces that bear against one another during use. During installation of the wear member, three of the corresponding bearing surfaces move parallel to each other whereas one bearing surface approaches the other corresponding bearing surface.

In another embodiment, a stepped edge of earth working equipment includes step segments each with a leading surface that extends perpendicular to the direction of advancement of the edge during operation of the equipment wherein adjacent step segments are laterally and axially spaced from each other, and transition segments interconnect adjacent step segments. The leading surfaces of the transition segments are inclined to the advancement of the edge during operation of the equipment. Bosses are secured on opposite sides of each transition segment. The boss on one side are all oriented the same, whereas the bosses on the opposite side are not all oriented the same. Wear members are receivable over the bosses for installation on the edge.

In another embodiment, a stepped edge of earth working equipment includes step segments each with a leading surface that extends perpendicular to the direction of advancement of the edge during operation of the equipment wherein adjacent step segments are laterally and axially spaced from each other, and transition segments interconnecting adjacent step segments wherein the leading surfaces of the transition segments are inclined to the advancement of the edge during operation of the equipment. Bosses are secured on one side of each transition segment. The longitudinal axis of each boss secured to one side is perpendicular to the leading surface of each transition segment, and each wear member is installed on the edge by moving in a direction parallel to the advancement of the edge during operation of the earth working equipment.

In another embodiment, a stepped edge of earth working equipment includes step segments each with a leading surface that extends perpendicular to the direction of advancement of the edge during operation of the equipment wherein adjacent step segments are laterally and axially spaced from each other, and transition segments interconnecting adjacent step segments wherein the leading surfaces of the transition segments are inclined to the advancement of the edge during operation of the equipment. Bosses are secured on opposite sides of each transition segment. The longitudinal axis of each boss secured to one side is perpendicular to the leading surface of each transition segment, whereas the longitudinal axis of each boss secured to the other side is parallel to the direction of advancement of the edge during operation of the earth working equipment.

In another embodiment, a shroud for covering an earth-working edge on earth working equipment includes a front end and a rearwardly-opening cavity. The cavity has opposed first and second surfaces to straddle the edge and a front surface extending between the first and second surfaces. The first surface includes a recess with opposed planar bearing surfaces to bear against a boss on the edge. These bearing surfaces converge toward the front surface.

In another embodiment, a shroud for covering an earth-working edge on earth working equipment includes a front end and a rearwardly-opening cavity. The cavity includes opposed first and second surfaces to straddle the edge and a front surface extending between the first and second surfaces. Each of the first and second surfaces includes a recess to receive a boss on the edge, and each of the recesses includes opposed bearing surfaces to bear against the received boss. The opposed bearing surfaces in the recess in the first surface converge toward the front surface.

In another embodiment, a shroud for covering an earth-working edge on earth working equipment includes a front end and a rearwardly-opening cavity. The cavity includes opposed first and second surfaces to straddle the edge and a front surface extending between the first and second surfaces. The first surface includes a first recess to receive a first boss on the edge where the first recess has a first longitudinal axis. The second surface includes a second recess to receive a second boss on the edge, where the second recess has a second longitudinal axis that is angularly oriented in a lateral direction to the first longitudinal axis.

In another embodiment, a shroud for covering an earth-working edge on earth working equipment includes a front end and a rearwardly-opening cavity. The cavity includes opposed first and second surfaces to straddle the edge and a front surface extending between the first and second surfaces. The first surface includes a first recess with opposed first bearing surfaces to bear against a boss on the edge. These first bearing surfaces converge toward the front surface. The second surface includes a second recess with opposed second bearing surfaces to bear against a boss on the edge. One of the first bearing surfaces is parallel to the second bearing surfaces and the other first bearing surface is transverse to the second bearing surfaces.

In another embodiment, a shroud for mounting on a lip of an excavating bucket that has a forward-facing leading surface, primary segments where the leading surface extends parallel to the width of the bucket, and transition segments where the leading surface is inclined to the primary segments includes a front end, a rearwardly-opening a cavity to receive the lip such that the shroud overlies a portion of the leading surface, and a lock-receiving opening having an elongate configuration. The cavity includes first and second opposed surfaces and a front surface extending between the first and second surfaces to oppose the leading surface. The lock-receiving opening has a length along which a major axis extends. The front surface and the major axis are generally parallel to the leading surface in the transition segment received in the cavity.

In another embodiment, a lip assembly for an earth working bucket includes a lip and a shroud. The lip has a forward-facing leading surface, primary segments where the leading surface extends parallel to the width of the bucket, and transition segments where the leading surface is inclined to the primary segments. The shroud is secured to a transition segment and includes a front end, a rearwardly-opening a cavity to receive the lip such that the shroud overlies a portion of the leading surface, and a lock-receiving opening. The cavity includes first and second opposed surfaces and a front surface extending between the first and second surfaces to oppose the leading surface. The lock-receiving opening has an elongate configuration with a length along which a major axis extends. The front surface and the major axis are generally parallel to the leading surface in the transition segment received in the cavity.

In another embodiment, a lip for an excavating bucket includes a forward-facing leading surface, an inner surface, an outer surface, primary segments where the leading surface extends parallel to the width of the bucket, and transition segments where the leading surface is inclined to the primary segments. At least one transition segment includes a first boss with a first longitudinal axis on the inner surface and a second boss with a second longitudinal axis on the outer surface that is angularly oriented in a lateral direction to the first longitudinal axis.

In another embodiment, a lip for an excavating bucket includes a forward-facing leading surface, an inner surface, an outer surface, primary segments where the leading surface extends parallel to the width of the bucket, transition segments where the leading surface is inclined to the primary segments, a plurality of first bosses each being identical and having a first longitudinal axis on the inner surface and a plurality of second bosses each being identical and having a second longitudinal axis on the outer surface. The first longitudinal axis of at least one of the first bosses is angularly oriented in a lateral direction to at least one of the second longitudinal axis.

In another embodiment, a lip for an excavating bucket includes a forward-facing leading surface, an inner surface, an outer surface, primary segments where the leading surface extends parallel to the width of the bucket, transition segments where the leading surface is inclined to the primary segments, and a plurality of bosses on one of the inner and outer surfaces. The bosses are identical with each other and at least one the bosses is oriented such that its longitudinal axis is angled relative to at least one other of the bosses.

In another embodiment, a lip for an excavating bucket includes a forward-facing leading surface, an outer surface, an inner surface with a beveled portion adjacent the leading surface, a plurality of first bosses fixed only to the beveled portion and a plurality second bosses separate from the first bosses fixed only to the outer surface.

In another embodiment, a process for installing a wear member on an earth-working edge on earth working equipment includes providing a shroud having spaced legs wherein each leg includes a recess defined by opposed bearing surfaces that receives a boss on the edge. The shroud is moved rearward so the edge is received into a cavity formed between the legs such that one boss moves parallel to the opposed bearing surfaces of one said recess and one boss approaches one of the bearing surfaces in the other recess. A lock is inserted into an opening in the shroud to engage the shroud and one of the bosses to secure the shroud to the edge The various features of the above-noted embodiments can be used independently of each other or collectively with all or some of the different features in securing a wear member to an edge of earth working equipment. The noted features are exemplary summary observations of certain ideas of the various concepts of the invention and are not intended to be exhaustive or essential. The foregoing and other objectives, features, and advantages of the disclosed embodiments will be more readily understood in view of the following detailed description of certain embodiments and the accompanying drawings. Understanding that the drawings depict only certain embodiments and are not, therefore, to be considered limiting in nature, these embodiments will be described and explained with additional specificity and detail.

DETAILED DESCRIPTION OF DISCLOSED EMBODIMENTS

Figure 1:
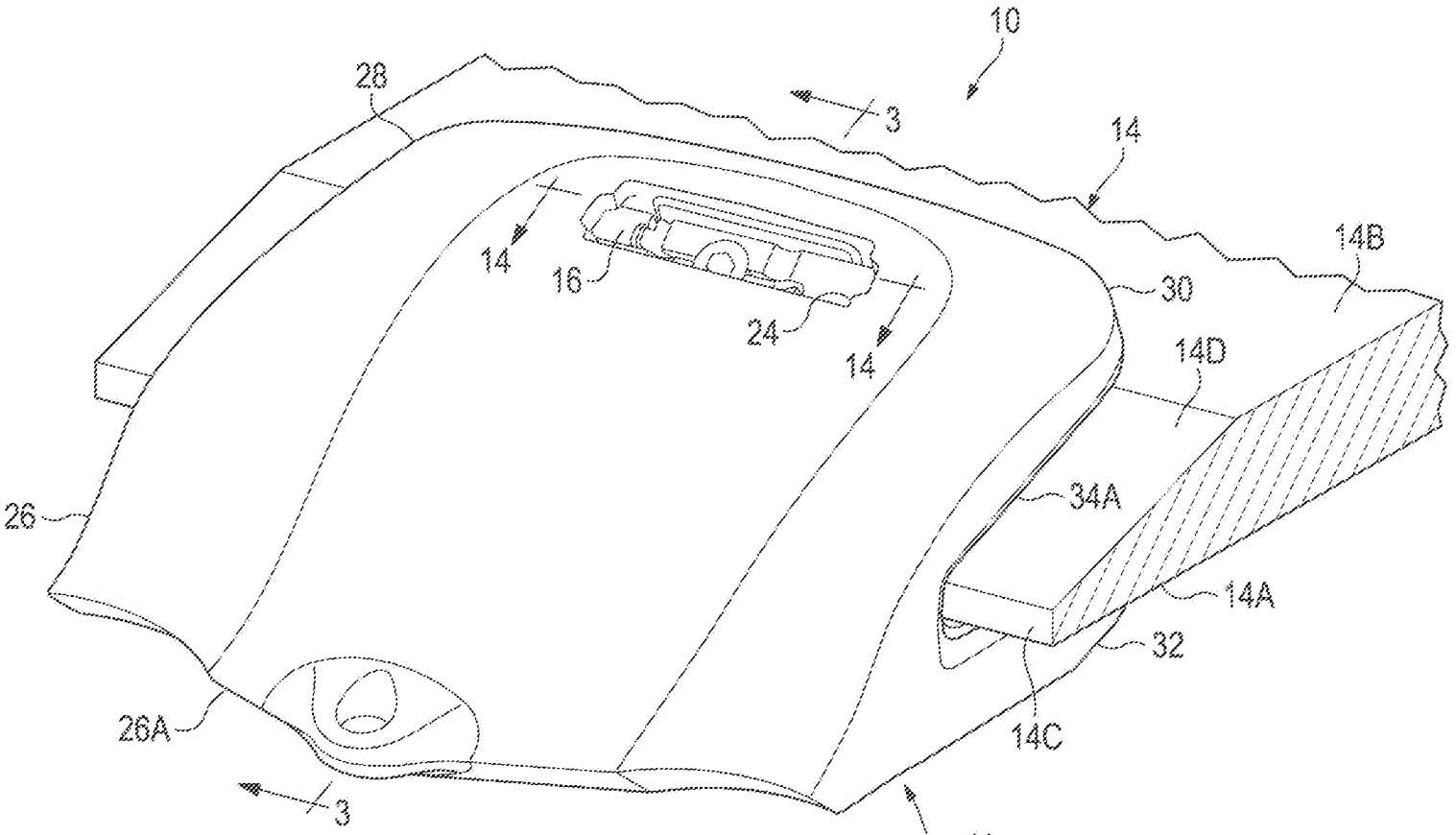
FIG. 1 is an upper perspective view of a wear assembly.

Wear members are applied to many kinds of earth working equipment to extend the service life of the equipment. The present invention is related to wear members and locking systems for securing the wear members to edges of earth working equipment, wear assemblies involving the same, edges of earth working equipment, and processes for installing wear members on such edges.

The figures show one embodiment of a wear assembly 10 including a wear member 12 for attachment to earth working equipment. In the illustrated example, the wear member is a shroud 12 attached to an edge of an earthmoving bucket; the edge as shown is defined by a lip 14 having an elongate body with a bottom or outer surface 14A, a top or inner surface 14B and a leading surface 14C. In this example, inner surface 14B includes a beveled portion or surface 14D adjacent leading surface 14C, and a rear portion rearward of the beveled portion. Shrouds in accordance with the invention may also be secured to the sidewalls of the bucket, ripper shanks, and/or other edges of earth working equipment; that is, shrouds 12 can be used in connection with a variety of different earth working components having earth working edges including, for example, buckets, lips, ripper shanks and the like.

The wear member 12 preferably includes an opening 24 that receives a lock 16 to releasably secure the wear member to the edge. The edge can have a variety of different designs including those with a linear leading surface, or a leading surface that is stepped or swept such that the center portion is forward or rearward relative to outer portions of the edge. The edge has a direction of advance during operation of the earth working equipment (e.g., a digging operation) that is generally in the direction to arrow 6 (FIGS. 12 and 13); this is referred to as the forward direction herein. The actual movement of the edge during operation can be a generally linear advance (such as, e.g., with a dragline bucket or ripper shank) or a compound motion with a swinging movement (such as, e.g., with a hydraulic excavator).

In the example of a bucket, the edge can be defined by a lip 14. Teeth 7 and shrouds 12 are secured along the front of the lip. In the illustrated example (FIG. 12), each tooth 7 includes an adapter 8 with rearward extending legs that are welded to the top and bottom surfaces of the lip or secured by mechanical means. The adapter includes a forwardly projecting nose 9 onto which is received a point 8A that is secured to the adapter by a lock (not shown). Shrouds 12 are secured to lip 14 in between adjacent teeth 7. Other configurations of the lip, the teeth and shrouds are possible. As one alternative example, the lip may include only shrouds such as in an LHD bucket. The lip can be formed by a casting process, or the lip can be cut from plate. The lip can also be welded together from separately formed sections.

The shroud 12 includes a front end or working portion 26 and a rear end or mounting portion 28 (FIGS. 1-7). In this embodiment, the working portion tapers to a narrowed front working edge 26A but other constructions are possible. During use, the working portion 26 contacts the earth or other material during the excavation process to protect the lip, ease penetration and/or gather material in the bucket. The mounting portion 28 includes a first leg 30, which in the illustrated embodiment is an inner or top leg 30, and an opposite second leg 32, which is an outer or bottom leg 32. The legs 30, 32 are spaced to define a cavity 40 to receive the lip 14 such that each leg extends rearward along the lip when the shroud is installed. A front surface or end wall 42 joins the first and second legs at the front end of cavity 40.

Figure 5:
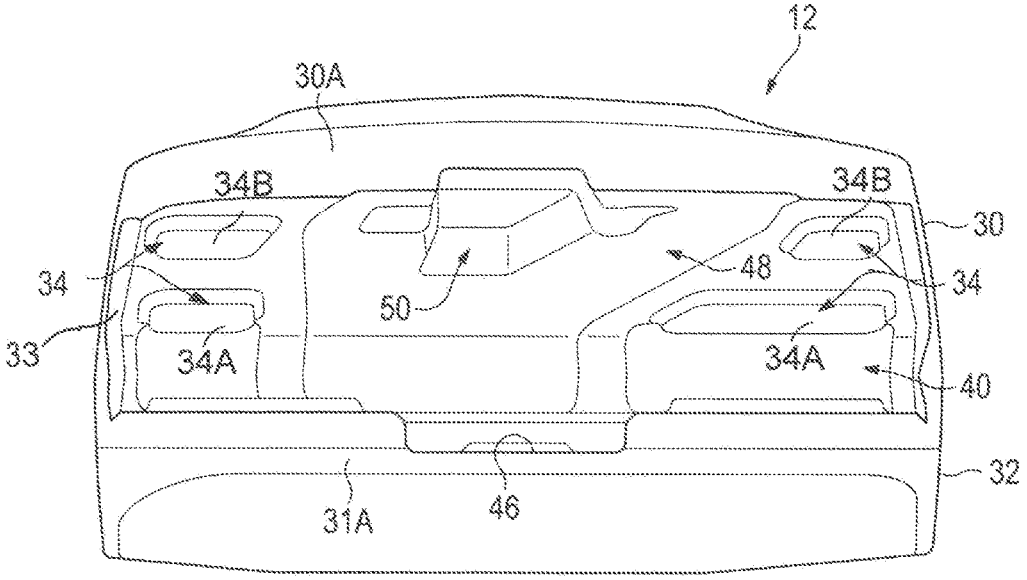
FIG. 5 is a rear perspective view of the shroud of FIG. 1.
Figure 7:
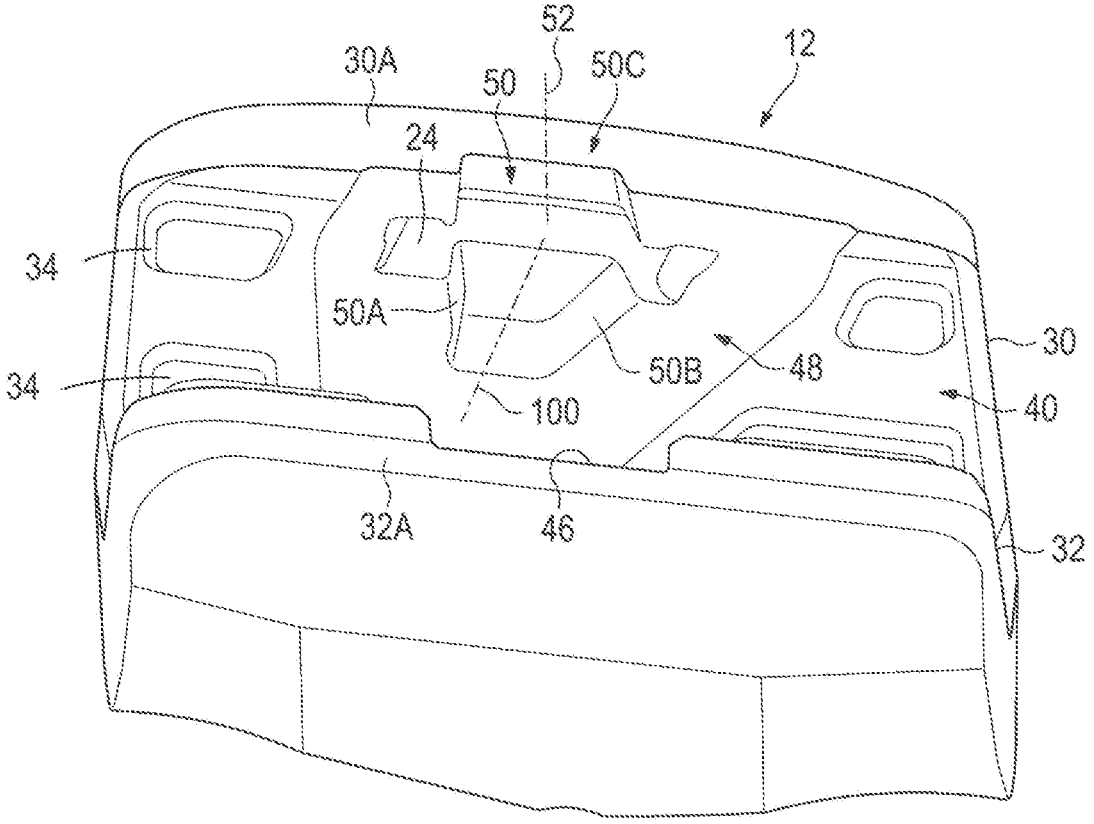
FIG. 7 is a rear perspective view of the shroud of FIG. 1.

The first leg 30 has an interior surface 33 that forms a first or inner surface of cavity 40, and which can include one or more first or inner bearing surfaces 34 that bear against the inner or top surface of the lip when assembled (FIGS. 5 and 7). The first bearing surfaces in this example are formed as raised bearing pads 34A, 34B, though they need not be so formed; the interior surface 33 itself could form the bearing surface or there could be other arrangements. The inner bearing surfaces bear on the beveled edge 14D of the lip. Alternatively, the forward bearing surfaces 34A are inclined to the rear bearing surfaces 34B such that bearing surfaces 34A bear against the front bevel surface 14D of the lip while bearing surfaces 34B bear against the inner or top surface 14B of the lip. The first leg also includes a rear surface 30A.

Figure 6:
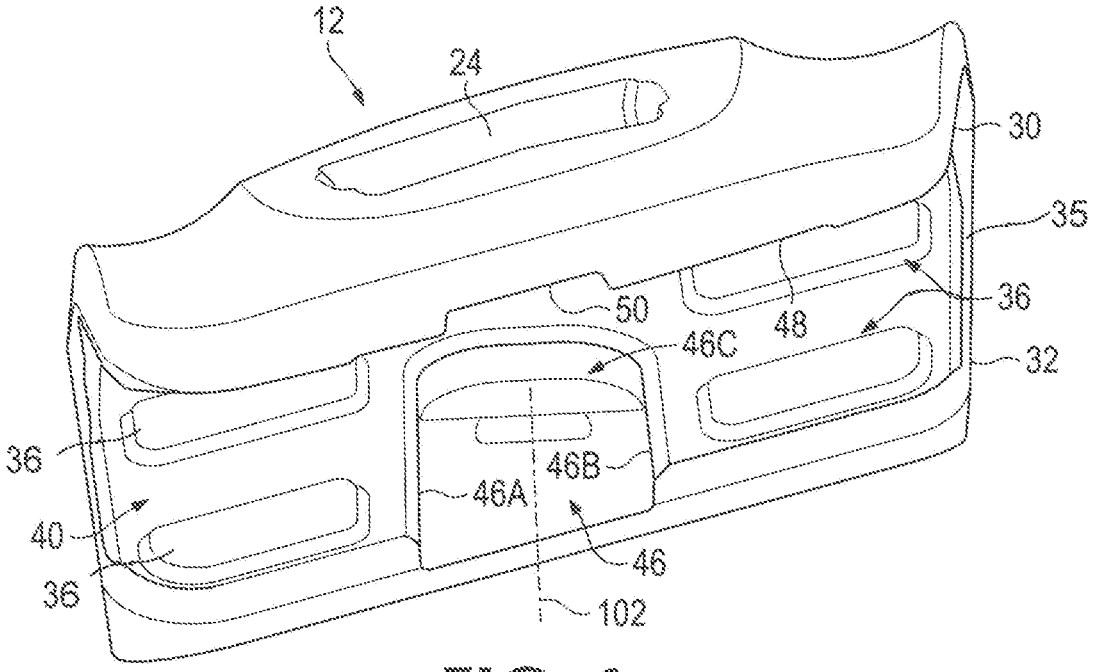
FIG. 6 is a rear perspective view of the shroud of FIG. 1.

The second or outer leg 32 includes an interior surface 35 that defines a second or outer surface of cavity 40. Interior surface 35 can include one or more second or outer bearing surfaces 36 to bear against the generally planar outer or bottom surface 14A of the lip (FIG. 6). In this example, second bearing surfaces 36 are formed as raised bearing pads, but they need not be; the interior surface 35 itself could define the bearing surface or there could be another arrangement. The second leg includes a rear surface 32A (FIGS. 5 and 7).

The front surface 42 extends between and joins legs 30, 32. Front surface 42 is adjacent to or bears against the leading or front surface 14C of the lip 14 when the shroud is fully installed on the lip. Opening 24 extends through the first leg 30 and opens to cavity 40 to receive a lock 16. Other arrangements for securing the wear member are possible. Other variations in the wear member 12 are also possible. For example, the cavity of the wear member is shaped to correspond to the configuration of edge 14, and could have varied shapes to complement different edges.

Figure 2:
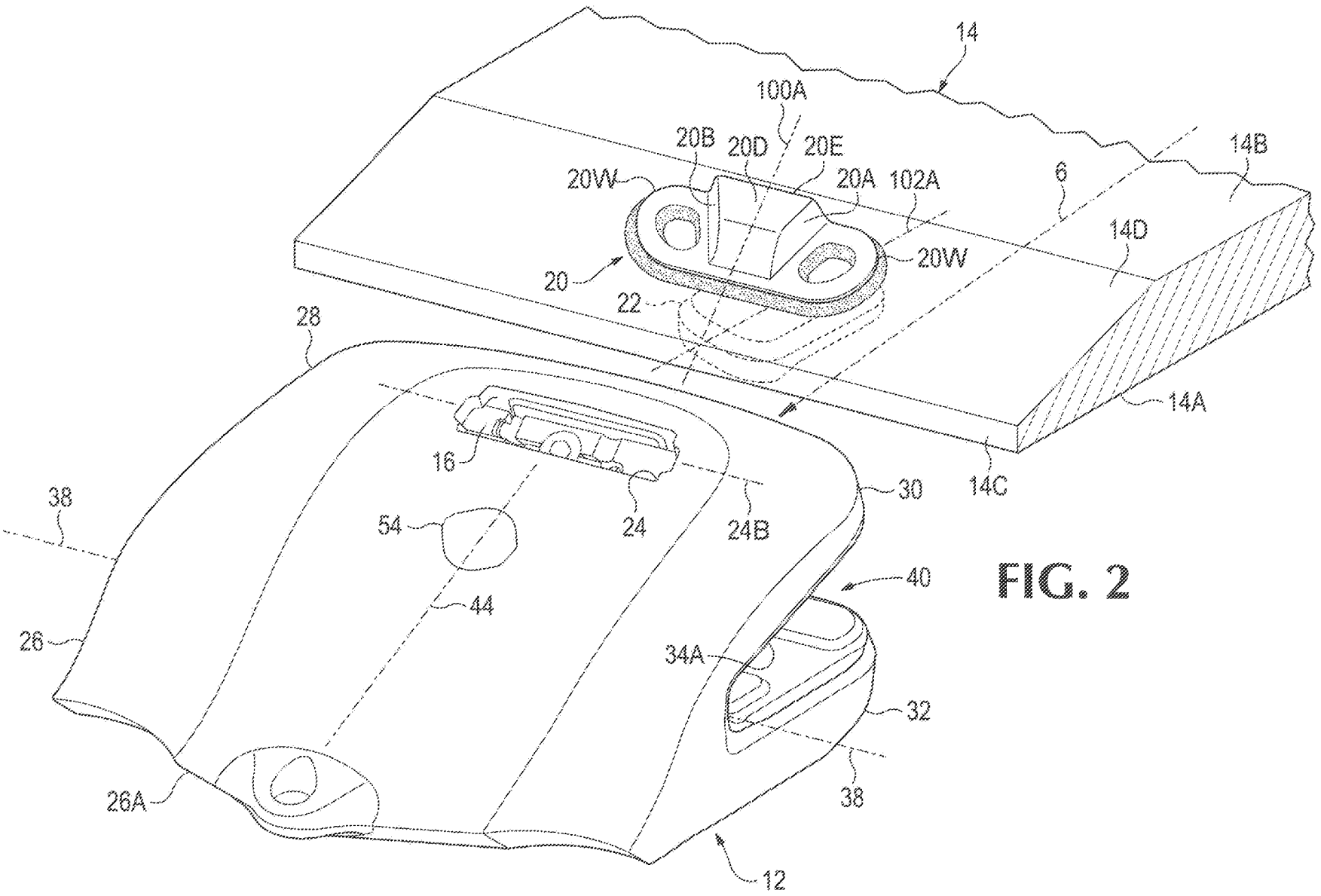
FIG. 2 is an exploded upper perspective view of the wear assembly of FIG. 1.
Figure 4:
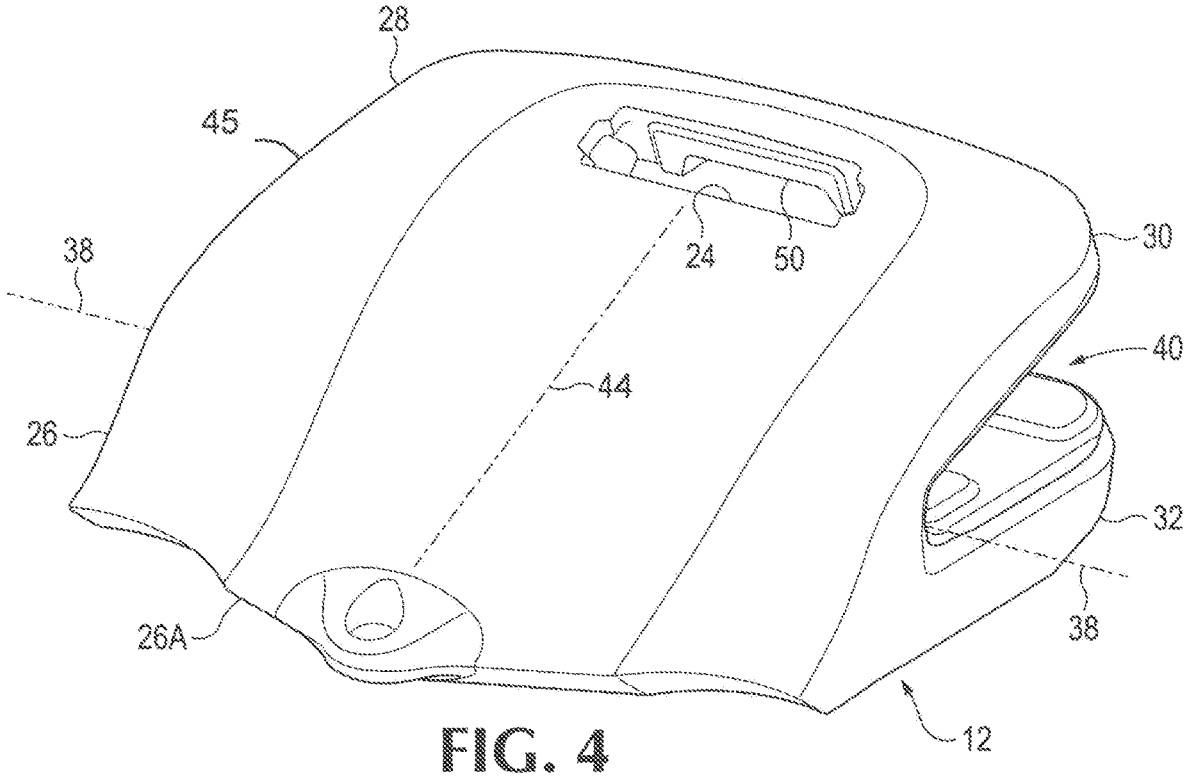
FIG. 4 is a front perspective view of the shroud of FIG. 1.

Each shroud 12 has a longitudinal axis 44 that is defined by a centerline extending generally in the direction of advancement of the edge 14 during operation of the earth working equipment (FIGS. 2 and 4). A datum line 38 extends along the front surface 42 and corresponds to the leading surface 14C when the shroud is installed. While the front of cavity 40 (i.e., along front surface 42) could have various configurations (such as including recesses), the front surface 42 is that portion of the front of the cavity that extends generally parallel to the leading edge it is designed to oppose.

The first leg 30 preferably includes a first or clearance recess 48 in interior surface 33 that extends forward from rear leg surface 30A (FIGS. 6 and 7). Within first recess 48 is a first supporting recess 50 that extends at a greater depth from the interior surface 33 than first recess 48. Recess 50 includes bearing surfaces 50A and 50B that converge in a forward direction, i.e., toward front surface 42. In this example, bearing surfaces 50A, 50B extend forward of opening 24 but other arrangements are possible. Bearing surfaces 50A, 50B can be planar, but other surface shapes are possible such as curved converging surfaces. A first recess axis 100 extends centrally between bearing surfaces 50A, 50B, and perpendicular to front surface 42. A rear recess 50C extends between rear leg surface 30A and opening 24 in general alignment with supporting recess 50, though in this example with a different extension (which is not necessary). Although recesses 50, 50C are discussed herein as separate recesses separated by opening 24, they could be considered as a single recess with front and rear portions. Rear recess axis 52 extends as a centerline of rear recess 50C and is generally parallel to the longitudinal axis 44 of shroud 12. Other alternatives are possible. For example, the first leg may only have a supporting recess 50 without the rear recess 50C provided sufficient clearance exists to receive the corresponding boss 20. Also, as another example, the bearing surfaces 50A, 50B could project from interior surface 33 to form recess 50 rather than be formed within a depression in the interior surface. Bearing surfaces 50A, 50B could also alternatively be formed in second leg 32 with a corresponding shift of the boss 20 it receives to the opposite surface 14A of edge 14. Other constructions are possible. In some embodiments, the rear recess axis 52 can be generally parallel to recess axis 100. Other arrangements are possible.

Figure 3:
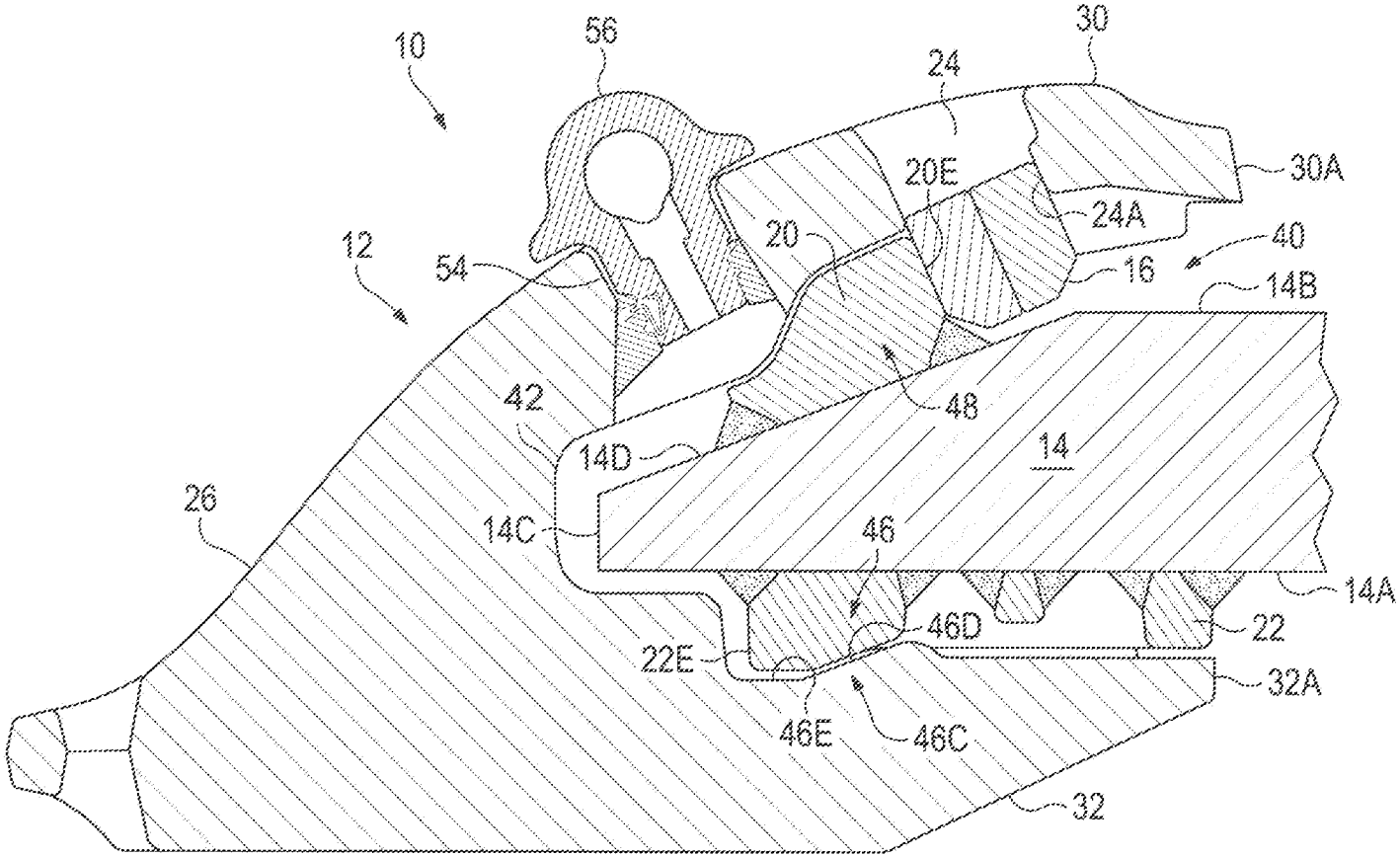
FIG. 3 is a cross section view of the wear assembly of FIG. 1 taken along the longitudinal axis of the wear assembly.
Figure 8:
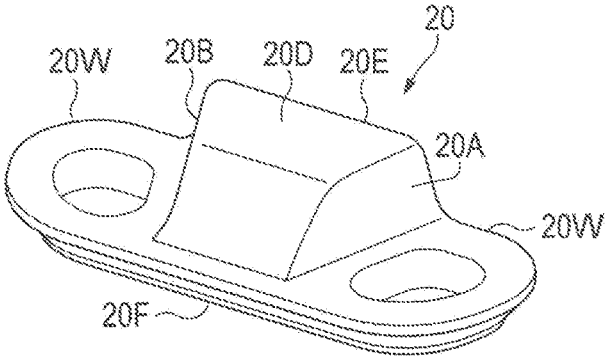
FIG. 8 is a front perspective view of a first boss of the wear assembly of FIG. 1.
Figure 9:
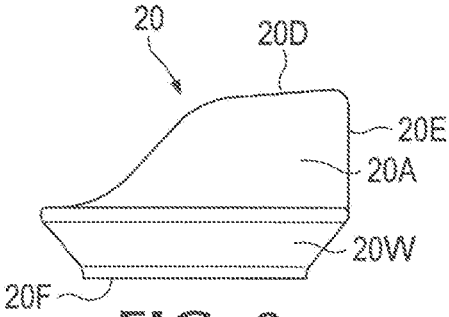
FIG. 9 is a side view of the first boss.

The lip 14 includes a first or inner boss 20 on the bevel 14D of an inner or upper surface 14B of the lip (FIGS. 2 and 3). Nevertheless, boss 20 could be rearward of bevel 14D or used on a lip without a bevel. The first boss includes side bearing surfaces 20A and 20B (FIGS. 2, 8 and 9) against which bearing surfaces 50A, 50B bear, and a rear bearing surface 20E against which lock 16 bears when shroud 12 is installed on lip 14; though other locks that bear on other surfaces are possible. The first boss 20 can include a base with a mounting surface 20F that sets against the edge. The base may include mounting wings 20W, though other mounting arrangements are possible. As one example, the wings could be omitted. The side bearing surfaces 20A and 20B can be formed on a lug 20D extending upward from the base. The rear bearing surface 20E extends transversely between side bearing surfaces 20A and 20B and faces generally rearward to abut lock 16.

The side bearing surfaces 20A, 20B of the boss 20 are preferably planar and converge in a forward direction from transverse bearing surface 20E. Side bearing surfaces 20A and 20B can, for example, converge forward at an angle of 10-40 degrees to each other. Preferably, the side bearing surfaces converge forward at an angle of 15-30 degrees to each other. The convergence of bearing surfaces 20A, 20B, though, could be outside these ranges. Bearing surfaces 50A, 50B also preferably have the same angular orientation as side bearing surfaces 20A, 20B. Boss 20 has a first boss axis 100A defined by the centerline between side bearing surfaces 20A, 20B. Boss axis 100A is generally perpendicular to the leading surface 14C of the lip that is closest to where boss 20 is fixed. Boss 20 can be attached to the lip by welding or other attachment means (e.g., bolts), machined in the lip or as cast configuration of the lip.

On assembly of shroud 12 to lip 14, cavity 40 receives lip 14 as the shroud moves rearward. Installing shroud 12 in a direction parallel to the direction of advance of the lip limits interference with adjacent teeth and/or noses secured to or forming part of the lip. This arrangement permits removal and/or installation of the shrouds without the need to remove points and/or adapters of adjacent teeth. Supporting recess 50 receives boss 20 such that bearing surfaces 50A, 50B oppose bearing surfaces 20A, 20B when shroud 12 is installed on lip 14. First recess 48 and rear recess 50C provide clearance for receiving boss 20 in recess 50, and/or for the boss mounting wings 20W or other mounting arrangement.

With the shroud seated on the lip and boss 20 received in recess 50 of the shroud, lock 16 can be inserted into a hole or opening 24. Opening 24 includes a bearing wall 24A to bear against a rear side of lock 16. The opposite front side of the lock bears on bearing surface 20E of first boss 20. Longitudinal forces on the shroud that urge the shroud off the lip are countered as the lock bears on the bearing wall 24A and bearing surface 20E to secure the shroud on the lip 14. Opening 24 is preferably elongate and defines a major axis 24B along its length, though other opening shapes are possible. Opening axis 24B is preferably parallel to front surface 42, though opening axis 24B may be inclined or perpendicular to the longitudinal axis 44 of the shroud. In one example, opening axis 24B is angled relative to longitudinal axis 44 between 65 to 90 degrees, though orientations outside this range are possible. The orientation of the lock opening (i.e., the opening axis 24B) corresponds to the orientation of the first boss 20 (i.e., to transverse surface 20E). Other locks fit into other openings is possible In the illustrated embodiment, lock 16 can include two portions that fold between an extended position that has a length that is longer than opening 24 (along major axis 24B) in exterior surface 45 of first leg 30 to prevent loss or removal of the lock from the wear member, and a folded position with a length that is shorter than opening 24 to permit release and/or removal of the lock from the opening, which may be when the shroud is installed on and/or removed from the lip. The lock can be of the kinds such as disclosed in U.S. Pat. No. 7,536,811 or US Patent Application 2017/0321396, which are each incorporated herein by reference in its entirety. Other lock configurations for securing the shroud to the lip are possible; various hammerless and hammered locks can be used.

As loads are applied to the shroud during earth working operations, bearing surfaces 50A and 50B of the supporting recess 50 bear on boss surfaces 20A and 20B to transfer loads to the lip. Mounting the first boss to the beveled portion of the lip allows the shroud to be mounted to certain lips of differing thicknesses. This enables the manufacture and/or stocking of fewer shroud sizes. Securing boss 20 to the bevel surface 14D can also enable the shroud to have a lower weight, a slimmer profile for easier penetration and/or less blocking of material in and out of the bucket. In one alternative embodiment, a boss 20 is only provided on one surface of the lip, which in this example is on the inner side 14B and specifically on ramp 14D, though the one boss could be provided rearward of ramp 14D or on outer side 14A. In another example, boss 20 could have a forward extension that overlies leading surface 14C.

The second leg 32 of shroud 12 includes a second supporting recess 46 in interior surface 35 that extends forward from back wall 32A to receive a second or outer boss 22. Recess 46 includes side bearing surfaces 46A and 46B and, optionally, a chin recess 46C further recessed from interior surface 35. The recess 46 has a second recess axis 102 defined by a centerline between side bearing surfaces 46A, 46B, and which is generally parallel to longitudinal axis 44 of shroud 12. The chin recess 46C can be defined by a ramp surface 46D inclined to interior surface 35. Alternatively, the chin recess can optionally also or in lieu of include a base surface 46E generally parallel to the interior surface 35 forward of ramp surface 46D. Other configurations of a chin recess are possible.

Figure 10:
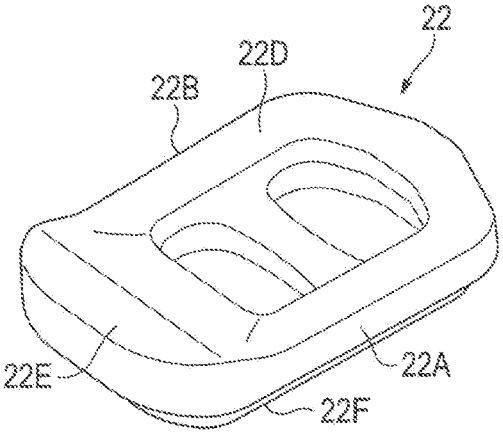
FIG. 10 is a front perspective view of a second boss of the wear assembly of FIG. 1.
Figure 11:
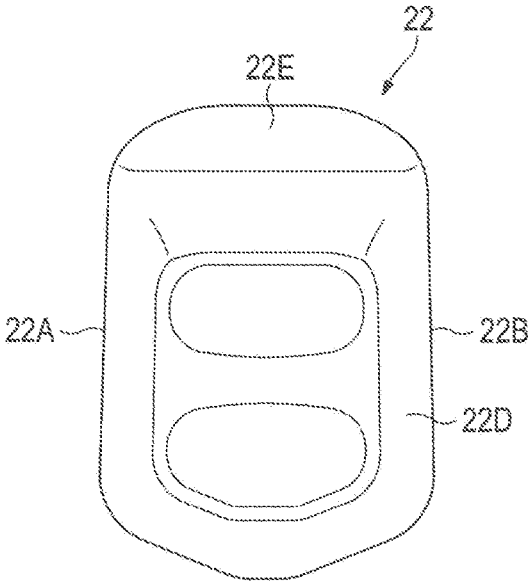
FIG. 11 is a top view of the second boss.

The lip includes a second or outer boss 22 on the lower surface 14A of the lip. The second boss includes side bearing surfaces 22A and 22B, and optionally a chin 22E that extends outward from the lip in a forward direction (FIGS. 10 and 11). Side bearing surfaces 22A and 22B can be parallel to each other. Alternatively, the side bearing surfaces can converge in a forward direction. Other configurations are possible. Boss 22 includes a mounting surface 22F that sets against the lip and an opposite outer surface 22D. Boss 22 can be attached to the lip by welding or by other attachment means (e.g., bolts). Boss 22 includes a second boss axis 102A defined by a centerline between bearing surfaces 22A, 22B, which will be generally parallel to the direction of lip advancement shown by arrow 6.

On assembly of shroud 12 to lip 14, cavity 40 receives lip 14 as the shroud moves rearward in relation to the lip along a direction opposite of arrow 6. First recess 50 receives first boss 20 and second recess 46 receives second boss 22. With the shroud fully seated on the lip, the side bearing surfaces 50A and 50B of first supporting recess 50 oppose bearing surfaces 20A and 20B of the first boss 20, and side bearing surfaces 46A and 46B of second supporting recess 46 oppose side bearing surfaces 22A and 22B of second boss 22. In the illustrated example, chin 22E is received in chin recess 46C, and lock 16 is received in opening 24 to secure the shroud to the lip as previously described.

As loads are applied to the shroud during earth working operations, bearing surfaces 50A and 50B of recess 50 bear on the bearing surfaces 20A and 20B of boss 20 to transfer loads applied to the shroud during earth working operations to the lip. Bearing surfaces 46A and 46B of recess 46 also bear on bearing surfaces 22A and 22B of boss 22 to transfer loads to the lip. Applied loads are transferred from the shroud to the lip through the bosses and bearing surfaces to limit wear to the lip. Applied loads are also transferred through the legs of the boss to the edge. The chin and the chin recess include inclined surfaces to resist reverse forces on the shroud urging the shroud off the lip, and thereby reduce such forces acting on the lock; as noted above, the chin and chin recess could be omitted. The use of a top boss only or the use of separate top and bottom bosses (FIG. 3) allow the same shroud to be mounted to lips of different thicknesses, which can reduce the number of different kinds and/or sizes of shrouds that need to be made or kept in inventory. In the illustrated example, the bosses are welded to the lip. Alternatively, one or both bosses can be integral with the lip; for example, the bosses could be included as part of a cast lip. Alternatively, one or both bosses could be formed by adding welding material to the lip or by other means.

Figure 12:
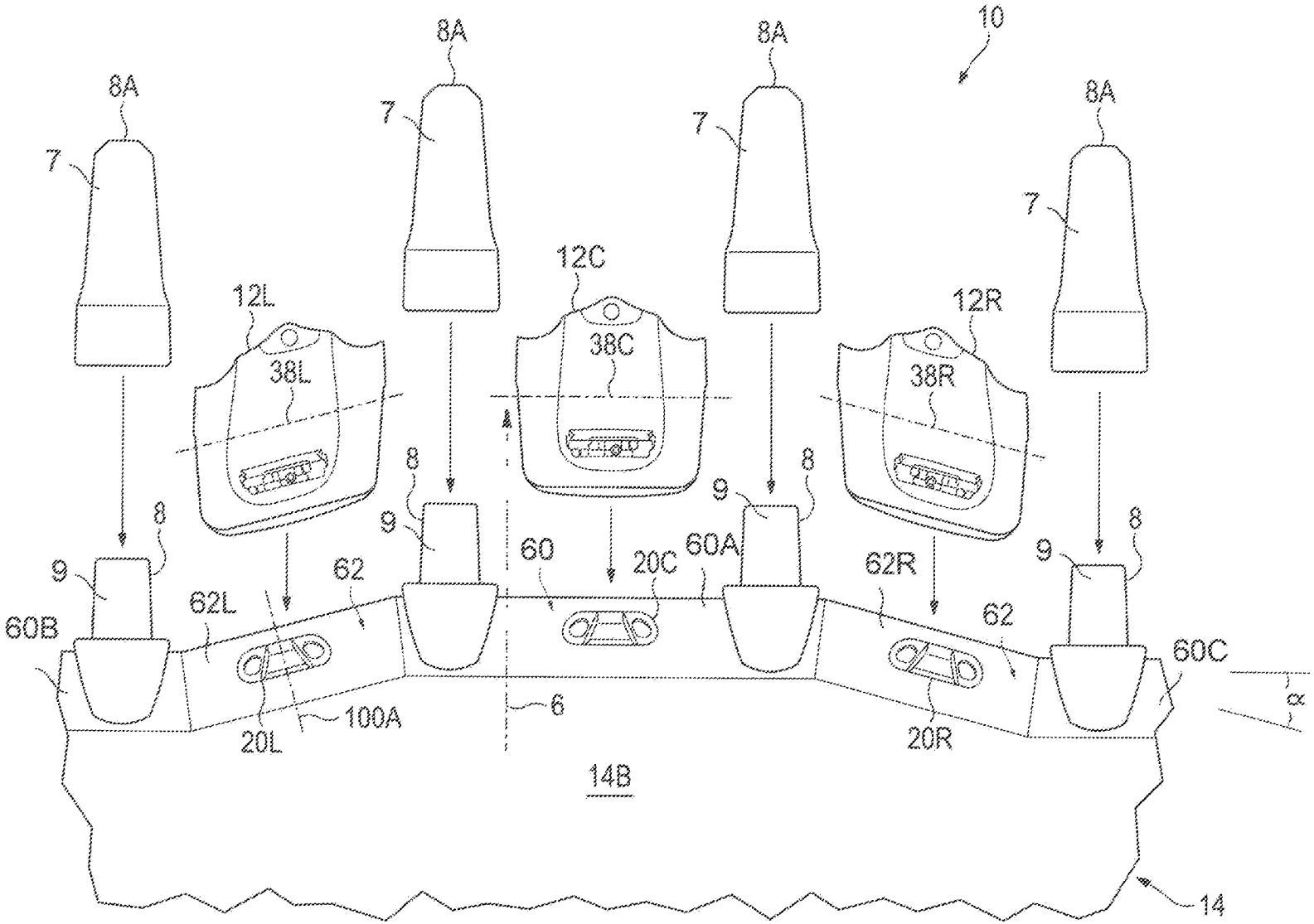
FIG. 12 is an exploded top view of a portion of a lip with teeth and shrouds, where the shrouds are the wear assemblies of FIG. 1.

FIG. 12 shows an exploded top view of lip 14 with shrouds 12 and teeth 7. The lip is stepped or swept so the center of the lip extends farther forward than the outer portions. In an alternative construction, the center portion could extend farther rearward than the outer portions. In this example, lip 14 includes a plurality of spaced apart stepped segments 60 where the leading edge 14C of the lip extends generally perpendicular to the advance of the lip along arrow 6, and a plurality of transition segments 62 interconnecting adjacent step segments 60. As shown in FIG. 12, lip 14 includes a central step segment 60A and an outer step segment 60B, 60C to each side of the central step segment 60A. Additional outer step and transition segments could and would usually also be included outside step segments 60B, 60C (not shown). Each step segment 60 could be identical or there could be differences. The leading edges 14C of transition segments 62 are inclined to the leading edges 14C of step segments 60; the angle of inclination a is commonly less than 22°, but other configurations are possible. Straight lips have a linear leading edge across the width of the bucket and, thus, will have zero angle of inclination on the transition segments extending between adjacent teeth. With a straight plate lip, there may be no differences between step and transition segments. Transition segments 62L, 62R to each side of central step segment 60A are preferably mirror images of each other, with transition segment 62L inclined in one direction and transition segment 62R inclined in the opposition direction, but all preferably at the same angle of inclination. In this example, two teeth 7 are secured to each step segment, and a shroud 12 is secured between each pair of adjacent teeth 7. Accordingly, shrouds 12 are secured to both step segments and transition segments. Nevertheless, various other configurations are possible. As one example alternative, one tooth could be secured to each step segment and a shroud secured to each transition segment.

Bosses 20 are secured to each segment 60, 62 that mounts a shroud 12. In this example, the lip includes a left boss 20L on a left transition segment 62L, a center boss 20C on center step segment 60A, and a right boss 20R on a right transition segment 62R; left and right used herein is solely for ease of explanation based on the view in FIG. 12. A left shroud 12L is shown to mount to boss 20L. A center shroud 12C is shown to mount to boss 20C. A right shroud 12R is shown to mount to boss 20R. While bosses 20 all preferably have the same construction, they are each secured at different orientations on the lip. Left and right shrouds are inclined in opposite directions to correspond to the inclination of the leading surfaces of transition segments 62 to which each attach. The boss axis 100A for each first boss 20 is generally perpendicular to the leading edge 14C of the step or transition segment 60, 62 to which it is secured, and generally perpendicular to the front surface 42 of the shroud 12 mounted over it. In FIG. 12, datum lines 38L, 38C, 38R show the orientation of the front surfaces 42 of the three different shrouds 12L, 12C, 12R. As can be seen, front surfaces 42 of left and right shrouds 12L, 12R are inclined to the advance direction 6 of lip 14. Since front surfaces 42 correspond to leading edge 14C of the different lip segments 60, 62, front surfaces 42 of left and right shrouds 12L, 12R are preferably inclined more than 80° to the direction of advance of the lip (i.e., arrow 6); though other orientations are possible. The front surface 42 of center shroud 12C will be generally perpendicular to the direction of lip advancement (i.e., arrow 6), and perpendicular to boss axis 100A of center boss 20C. Some lips can include only left shrouds and right shrouds with no center shrouds. Alternatively, a straight lip with no inclination will include only center shrouds.

Figure 13:
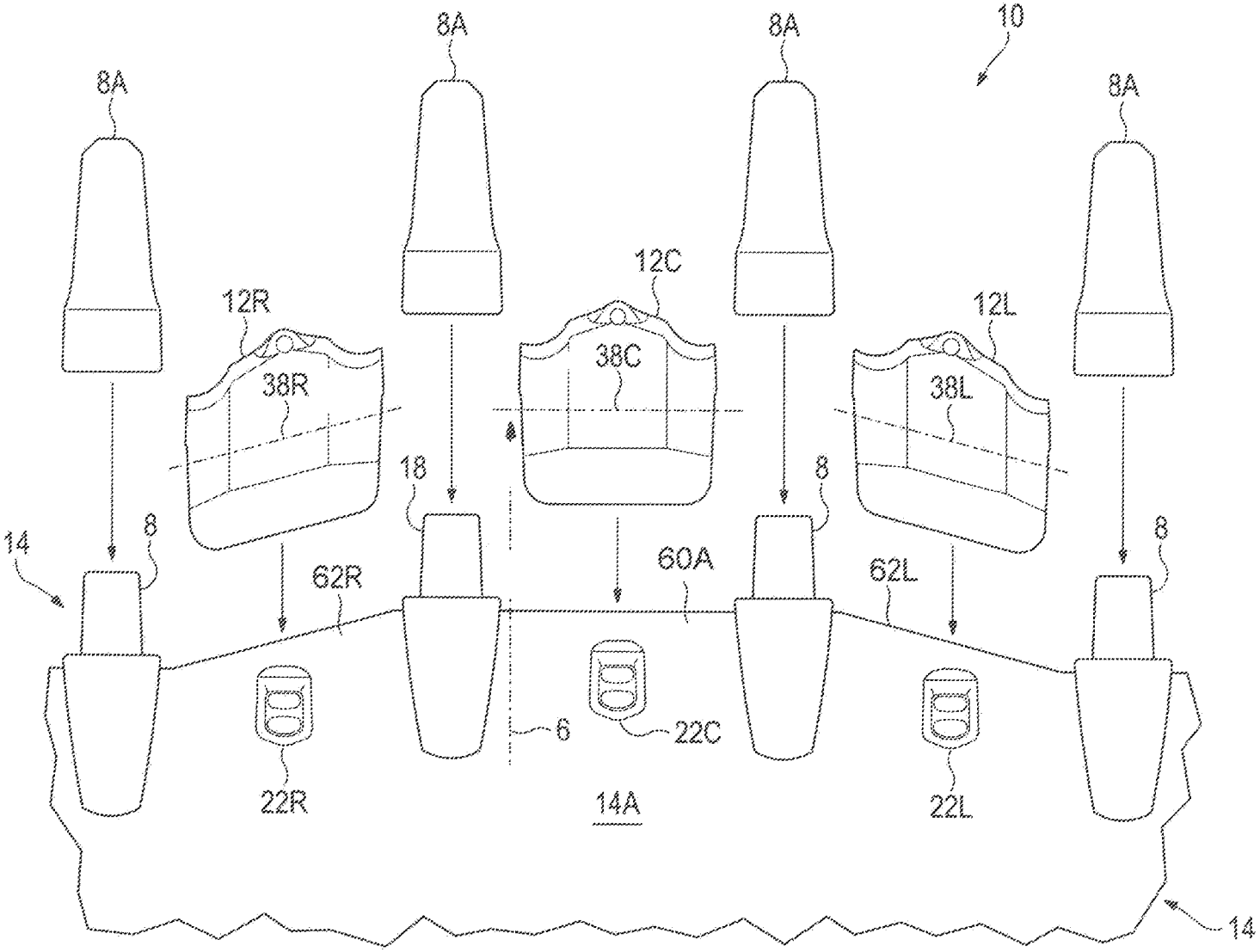
FIG. 13 is an exploded bottom view of the lip of FIG. 12.

FIG. 13 shows an exploded bottom view of lip 14 with shrouds 12 and teeth 7. The bottom surface 14A of the lip includes bosses 22 secured to each lip segment 60, 62 to which a shroud is secured. In this example, boss 22L is secured to transition segment 62L, boss 22C is secured to primary or step segment 60A, and boss 22R is secured to transition segment 62R. Each of the second bosses 22 preferably have the same construction, and the same orientation, i.e., such that second boss axes 102A are each generally parallel to the direction of lip advancement (i.e., line 6).

FIG. 13 shows shroud 12L about to be installed on transition segment 62L of lip 14. First boss 20 will be received in first supporting recess 50, and second boss 22 will be received in second supporting recess 46. As can be seen, the boss axes 100A, 102A are angularly oriented to each other (FIGS. 2, 12 and 13) in a lateral direction (i.e., in a side-to-side direction and not with respect to axial or vertical directions). The second recess axis 102 is parallel to and aligned with second boss axis 102A. The receipt of boss 22 into recess 46, then, controls the installation movement of shroud 12. This movement is parallel to the direction of lip advancement along arrow 6 and to the extension of teeth 7 from the lip so the shroud may be installed and removed without interference from the teeth. Bearing surfaces 20A, 20B and 50A, 50B are angled to resist the rearward and side loads applied to shrouds. When shroud 12 is secured to a transition segment 62, recess axis 100 and boss axis 100A are inclined to the direction of lip advancement. In connection with shroud 12L, bearing surface 20A of first boss 20 is generally aligned with bearing surface 22A of second boss 22. During installation of shroud 12L, then, bearing surface 50A will move parallel to bearing surface 20A, bearing surface 46A will move parallel to bearing surface 22A, and bearing surface 46B will move parallel to bearing surface 22B. However, bearing surface 50B will move toward bearing surface 20B until they meet in opposition to each other when shroud 12L is fully seated on lip 14. Clearance recess 48 and rear recess 50C enable boss 20 to be pass into a fully seated position against bearing surfaces 50A, 50B on shroud 12. Other shaped recesses or other constructions could be used to provide the needed clearance. Removal of shroud 12L will be the reverse of the installation.

The installation of right shrouds 12R would be the mirror image of the installation of shrouds 12L. In particular, bearing surface 50B of first supporting recess 50 will move parallel to bearing surface 20B of first boss 20B, while bearing surfaces 46A, 46B move parallel to bearing surfaces 22A, 22B. Bearing surface 50A during installation will move toward and then meet bearing surface 20A when the shroud is fully seated. Removal of shroud 12R will be the reverse of the installation.

In the installation of a center shroud 12C, bearing surfaces 46A, 46B of second supporting recess 46 move parallel to bearing surfaces 22A, 22B of second boss 22. However, both bearing surfaces 50A, 50B of recess 50 will move toward bearing surfaces 20A, 20B, respectively, until both meet in opposition to each other. This is also the case for shrouds mounted on straight lips and spade lips with spade lips where the transition segments have a smaller inclination. Removal of shroud 12C will be the reverse of the installation.

Shroud 12 can optionally include an opening 54 that receives a mechanically attached lifting eye 56 such as disclosed in US Patent Application 2015/0013134, which is incorporated herein by reference in its entirety. A cast-in eye (not shown), one or more eyes in other locations, or no eye could be used.

Figure 8A:
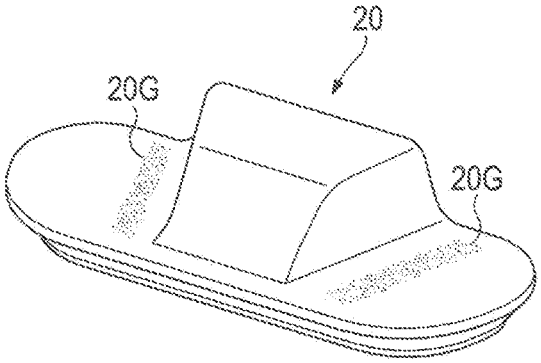
FIG. 8A is a front perspective view of an alternative design of the first boss.

One or both bosses can optionally incorporate strain reliefs. The first boss 20 can include strain relief 20G between the side bearing surfaces and the boss wings 20W (FIG. 8A). The boss wings can be welded to the lip and the middle portion of the boss (i.e., the portion between boss wings 20W and supporting boss lug 20D) remains without being rigidly secured to the lip. Strain reliefs such as cutouts of the boss material or a section of material with different material properties can be incorporated between the boss lug and the wings. Loads applied to the boss will, then, cause the boss lug to deflect. The loads may be partially absorbed at the strain reliefs at the sides of the boss lug to spread the load more evenly over the wing welds. This limits stress concentrations that can result in cracking at the welds. Other kinds of strain relief such as disclosed in U.S. Pat. No. 8,925,220, which is incorporated herein by reference in its entirety, could also be used.

Figure 14:
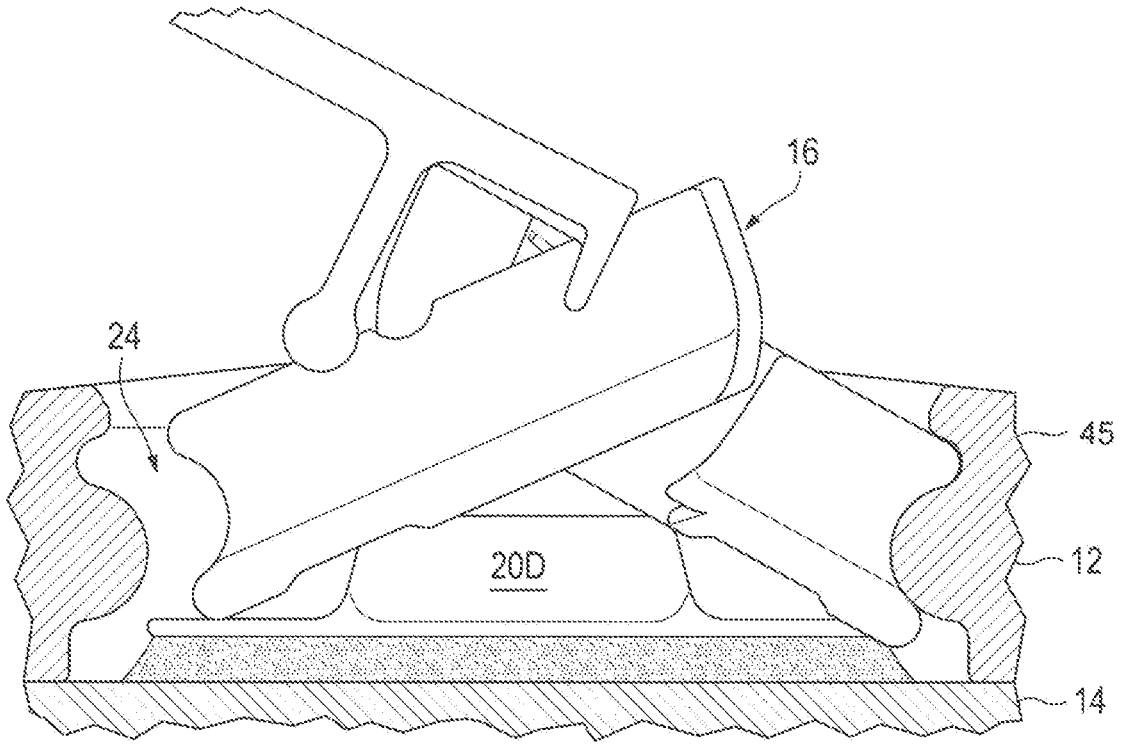
FIG. 14 is a cross section view along the longitudinal axis of the opening of the shroud in the wear assembly of FIG. 1 with an inserted lock in a folded orientation.
Figure 14A:
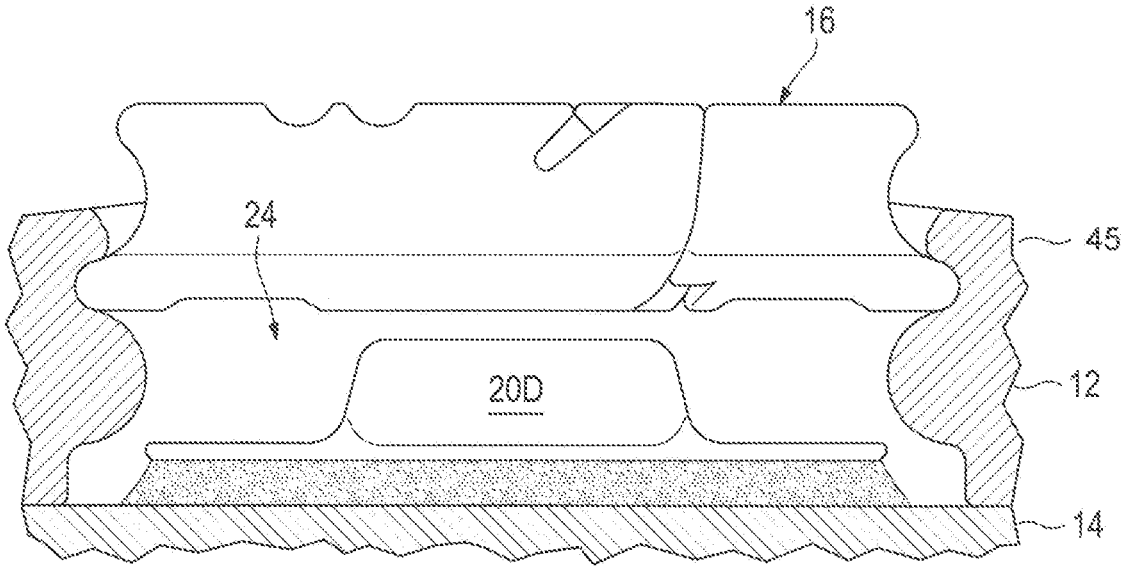
FIG. 14A is the same cross section view as FIG. 14 with the lock in an extended orientation in a release position such as for installation, removal and/or shipping.

Opening 24 can optionally be configured with two positions for lock 16 (FIGS. 14 and 14A), a locking position and a release position, such as disclosed in US Patent Application 2017/0321396, which is incorporated herein by reference in its entirety.

The wear assembly provides support for the wear member during operation. Forces applied to the wear member 12 can cause the wear member to shift and bear on the leading surface 14C, converging faces 20A, 20B of the first boss 20, the side bearing surfaces 22A, 22B of the second boss 22 and/or the outer and inner surfaces 14A, 14B. Bottom and/or reverse loads can be resisted in part through chin 22E and recess 46C if a chin is provided. The loads applied to the bosses are transferred through the bosses to the lip. The first boss 20 can be attached to the beveled front surface of the lip. This allows the wear member to be used with a range of different lip thicknesses without stocking different bases for different lip configurations, thus reducing the need to manufacture or hold inventory of additional kinds of parts for certain lips with different thicknesses. The wear assembly can provide reduced weight and/or profile and/or efficient replacement of worn wear members, and/or can reduce downtime and/or operating expenses for earth working equipment.

The invention is described herein in the context of a shroud for a bucket. It should be understood that this is merely one example of the disclosed subject matter and is not meant to be limiting. Shrouds in accordance with the present invention may have other constructions for use on a wide variety of buckets including, for example, buckets for hydraulic excavators, loaders, cable shovels, face shovels, etc., or for use on other products such as ripper shanks. The wear members may be secured to a lip, to a base secured to the lip, to other portions of a bucket, or to other earth working equipment. Relative terms such as top, bottom, forward, rearward, left and right are used herein for ease of discussion and are not intended to be limiting.

With reference to the drawings, this specification describes particular embodiments and their detailed construction and operation. The embodiments described are set forth by way of illustration only and not limitation. The described features, structures, characteristics, and methods of operation may be combined in any suitable manner in one or more embodiments. In view of the disclosure herein, those skilled in the art will recognize that the various embodiments can be practiced without one or more of the specific details or with other methods, components, materials, or the like. In other instances, well-known structures, materials, or methods of operation are not shown or not described in detail to avoid obscuring more pertinent aspects of the embodiments. It is intended that subject matter disclosed in any one portion herein can be combined with the subject matter of one or more other portions herein as long as such combinations are not mutually exclusive or inoperable. In addition, many variations, enhancements and modifications of the concepts described herein are possible. Those skilled in the art will recognize that many variations can be made to the details of the above-described embodiments without departing from the underlying principles of the invention.

The invention claimed is:

1. A shroud for an earth-working edge on earth working equipment comprising:

a front end;

a rearwardly-opening cavity including opposed first and second surfaces to straddle the edge and a front surface extending between the first and second surfaces, the first surface including a recess with opposed planar bearing surfaces to bear against a boss on the edge, wherein the opposed planar bearing surfaces converge toward the front surface, and the second surface including a recess with opposed side bearing surfaces to bear against a second boss on the edge; and a lock-receiving hole opening in one of the first and second surfaces to receive a lock rearward of the respective boss.

2. The shroud of claim 1 wherein the bearing surfaces converge at an angle of 10-40 degrees to each other.

3. The shroud of claim 1 wherein the recess in the first surface has a first longitudinal axis, and the recess in the second surface has a second longitudinal axis that is angularly oriented in a lateral direction to the first longitudinal direction.

4. A shroud for an earth-working edge on earth working equipment comprising a front end and a rearwardly-opening cavity including opposed first and second surfaces to straddle the edge and a front surface extending between the first and second surfaces, each of the first and second surfaces including a recess to receive a boss on the edge, wherein the recess in the first surface has a first longitudinal axis, and the recess in the second surface has a second longitudinal axis that is angularly oriented in a lateral direction to the first longitudinal direction, and each said recess including opposed bearing surfaces to bear against the received boss, wherein the opposed bearing surfaces in the recess in the first surface converge toward the front surface.

5. The shroud of claim 4 wherein the bearing surfaces in the recess in the first surface converge at an angle of 10-40 degrees to each other.

6. The shroud of claim 4 including a lock-receiving hole opening in the first surface rearward of converging bearing surfaces.

7. A shroud for an earth-working edge on earth working equipment comprising a front end and a rearwardly-opening cavity including opposed first and second surfaces to straddle the edge and a front surface extending between the first and second surfaces, the first surface including a first recess to receive a first boss on the edge, the first recess having a first longitudinal axis, the second surface including a second recess to receive a second boss on the edge, and the second recess having a second longitudinal axis that is angularly oriented in a lateral direction to the first longitudinal axis.

8. The shroud of claim 7 wherein the first recess includes opposed bearing surfaces that converge toward the front surface.

9. The shroud of claim 8 wherein the bearing surfaces are planar and converge at an angle of 10-40 degrees to each other.

10. The shroud of claim 9 including a lock-receiving hole opening in the first surface rearward of converging surfaces.

11. The shroud of claim 7 including a lock-receiving hole opening in the first surface to receive a lock rearward of boss.

12. A shroud for an earth-working edge on earth working equipment comprising a front end and a rearwardly-opening cavity including opposed first and second surfaces to straddle the edge and a front surface extending between the first and second surfaces, the first surface including a first recess with opposed first bearing surfaces to bear against a boss on the edge, the first bearing surfaces converging toward the front surface, and the second surface including a second recess with opposed second bearing surfaces to bear against a boss on the edge, wherein one of the first bearing surfaces is parallel to the second bearing surfaces and the other first bearing surface is transverse to the second bearing surfaces.

13. The shroud of claim 12 wherein the first bearing surfaces converge at an angle of 10-40 degrees to each other.

14. The shroud of claim 12 wherein the first recess has a first longitudinal axis, and the second recess has a second longitudinal axis that is angularly oriented in a lateral direction to the first longitudinal direction.

15. The shroud of claim 12 including a lock-receiving hole opening in one of the first and second surfaces to receive a lock rearward of boss.

* * * * *